US005600611A

United States Patent [19]

Kamens

[11] Patent Number: 5,600,611

[45] Date of Patent: Feb. 4, 1997

[54] WRIST MOUNTABLE COMPASS

[75] Inventor: Bruce H. Kamens, Thomaston, Conn.

[73] Assignee: Timex Corporation, Middlebury, Conn.

[21] Appl. No.: 539,141

[22] Filed: Oct. 4, 1995

[51] Int. Cl.[6] ..... G04B 47/00

[52] U.S. Cl. ..... 368/10; 368/14; 368/281

[58] Field of Search ..... 368/10, 14, 223, 368/228, 219, 241, 281, 282, 278; 33/271, 272

[56] References Cited

U.S. PATENT DOCUMENTS

| | | | |
|---|---|---|---|
| 4,321,519 | 3/1982 | Ueda et al. | 318/696 |
| 4,482,255 | 11/1994 | Gygax et al. | 368/10 |
| 4,512,667 | 4/1985 | Doulton et al. | 368/10 |
| 4,640,016 | 2/1987 | Tanner et al. | 33/286 |
| 4,668,100 | 5/1987 | Murakami et al. | 368/10 |
| 4,702,612 | 10/1987 | Finger | 368/10 |
| 4,894,922 | 1/1990 | Lovelock | 33/272 |
| 5,187,437 | 2/1993 | Rydergren et al. | 324/253 |
| 5,351,005 | 9/1994 | Rouse et al. | 324/252 |

OTHER PUBLICATIONS

Philips Electroni Components and Materials Technical Publication No. 268 "The magnetoresistive sensor: a sensitive device for detecting magnetic–field variations".

*Primary Examiner*—Bernard Roskoski
*Attorney, Agent, or Firm*—William C. Crutcher

[57] ABSTRACT

A wrist mountable compass capable of directing a user to a selected compass direction is provided. In the preferred embodiment of the compass, the user selects the compass direction. The user is directed to the selected direction by digital pointers appearing on the compass. The compass utilizes a single magnetoresistive sensor to sense the polarity of the horizontal flux lines of the earth's magnetic field.

6 Claims, 6 Drawing Sheets

WRIST MOUNTABLE COMPASS

This invention relates to an improved wrist instrument for indicating direction. More specifically, the invention concerns a wrist mountable compass which utilizes a single magnetoresistive sensor.

BACKGROUND OF THE INVENTION

Wrist mountable compasses for indicating direction are well-known in the art. For example, U.S. Pat. No. 4,482,255, which issued on Nov. 13, 1984 to Gygax et al., discloses a watch having an electro-optic display with digital indication means for indicating the direction in which the display should be turned in order to be aligned with a fixed axis, e.g., the preselected direction north. As shown in FIGS. 1*a* and 1*b* of the drawing, corresponding respectively to FIGS. 1*b* and 1*d* of the '255 patent, the fixed axis 9 is represented by a vertical line appearing on the display 3, and the digital indication means are comprised of arrows 16 and 17 and numerals 55, where the numerals 55 represent the angle in degrees which the fixed axis 9 assumes relative to the preselected direction (in this case, the direction north). In the example of FIG. 1*a*, the fixed axis 9 makes an angle of 88° with the direction north, and it is therefore necessary to turn the watch in the direction indicated by the arrow 16 in order to have the fixed axis 9 coincide with the direction north. FIG. 1*b* illustrates how the display 3 will appear at the moment of coincidence: each of the numerals 55 is zero, and in addition to the first arrow 16, there appears a second arrow 17, the point of which is directed against the point of the first arrow 16. The '255 patent utilizes Hall-effect sensors to achieve the objects of the invention.

It is also known to utilize magnetoresistive sensors in compasses. In U.S. Pat. No. 4,640,016 issued to Tanner et al. on Feb. 3, 1987, there is disclosed a compass having magnetoresistive sensors to indicate the direction of the horizontal component of the earth's magnetic field. Unlike the Hall-effect sensors, which make use of the property of a current-carrying semiconductor membrane (Hall element) to generate a voltage perpendicular to the direction of current flow when subjected to a magnetic field normal to its surface, the magnetoresistive sensors make use of the property of a current-carrying magnetic material to change its resistivity in the presence of an external magnetic field.

Although existing compasses are generally effective for indicating direction, they present certain disadvantages because of their utilization of at least two sensors. The '255 patent, for instance, employs two non-coplanar Hall-effect sensors orthogonally arranged relative to one another. As a matter of fact, the '255 patent explicitly states that two sensors are needed since using only one sensor would generally result in incorrect directional indications (column 3, lines 22–27). For the '016 patent, two or more magnetoresistive sensors are needed (column 3, lines 25–27). The drawbacks of utilizing at least two sensors, as opposed to one sensor, are: higher power drain, duplication of some circuit components, more complex circuitry and inaccuracies caused by scaling error. It is therefore the object of the present invention to overcome these disadvantages by employing only one sensor in a wrist mountable compass.

SUMMARY OF THE INVENTION

Briefly stated, the present invention concerns a wrist mountable compass having means for fastening to a wrist of a user, which comprises a magnetoresistive sensor coupled to a circuit means for sensing the polarity of the horizontal flux lines of the earth's magnetic field, means for selecting a compass direction, a marking on the wrist mountable compass for orienting the compass relative to the horizontal flux lines of the earth's magnetic field, an operating switch for activating the magnetoresistive sensor and the circuit means, and direction indicating means coupled to the circuit means for indicating the direction in which the wrist mountable compass should be turned so that the marking on the compass is directed towards the selected compass direction.

BRIEF DESCRIPTION OF THE DRAWINGS

The subject matter, which is regarded as the invention, is particularly pointed out and distinctly claimed in the concluding portion of the specification. The invention, however, both as to organization and to method of practice, together with further objects and advantages thereof, may best be understood by reference to the following description, taken in connection with the accompanying drawings, in which:

DETAILED DESCRIPTION OF THE PREFERRED EMBODIMENT

Figure 1A:
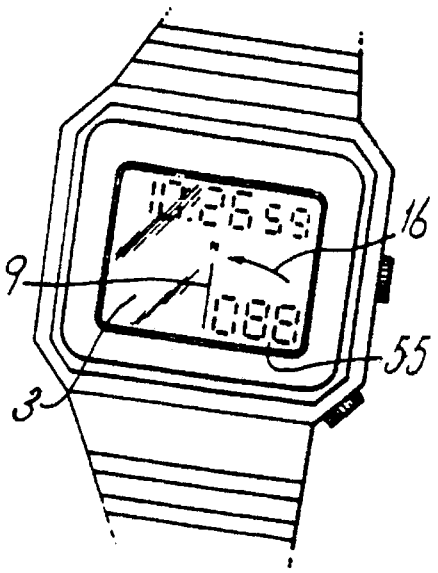
Fig. 1a Prior Art
FIGS. 1*a* and 1*b* are from U.S. Pat. No. 4,482,255.
Figure 1B:
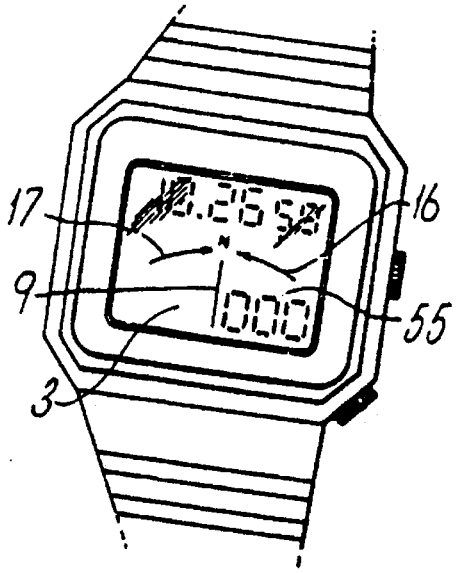
Fig. 1b Prior Art

The present invention utilizes a single magnetoresistive sensor to achieve the objects of the invention. Philips' KMZ10A1 magnetoresistive sensor, as disclosed in Electronic components and materials, Technical publication 268 by Philips, is specifically employed in the preferred embodiment. The KMZ10A1 comprises four permalloy strips arranged in a meander pattern on a silicon substrate and connected to form the four arms of a Wheatstone bridge (see FIG. 1 on page 2 in the aforementioned Technical publication 268). The degree of the bridge imbalance is then used to indicate the magnetic field strength and polarity. It is this latter parameter, i.e. polarity, which is utilized in a wrist mountable compass of the present invention.

Unlike a conventional mechanical compass in which a magnetized compass needle aligns itself with the horizontal flux lines of the earth's magnetic field, the wrist mountable compass of the present invention senses and displays the polarity of the horizontal magnetic flux lines. This is accomplished by utilization of a "null-field" method, in which the field to be measured is compensated by a coil, the current through the coil serving as a measure of the field. The polarity changes as the sensitive axis of the Philips' KMZ10A1 magnetoresistive sensor is rotated through the null-field, which occurs in the East-West direction, normal to the horizontal flux lines. The polarity sensed by the KMZ10A1 sensor is displayed via direction indicating means (e.g., digital pointers) to guide a user of the wrist mountable compass as to which direction to rotate the compass in order to align it with the null-field.

Figure 2:
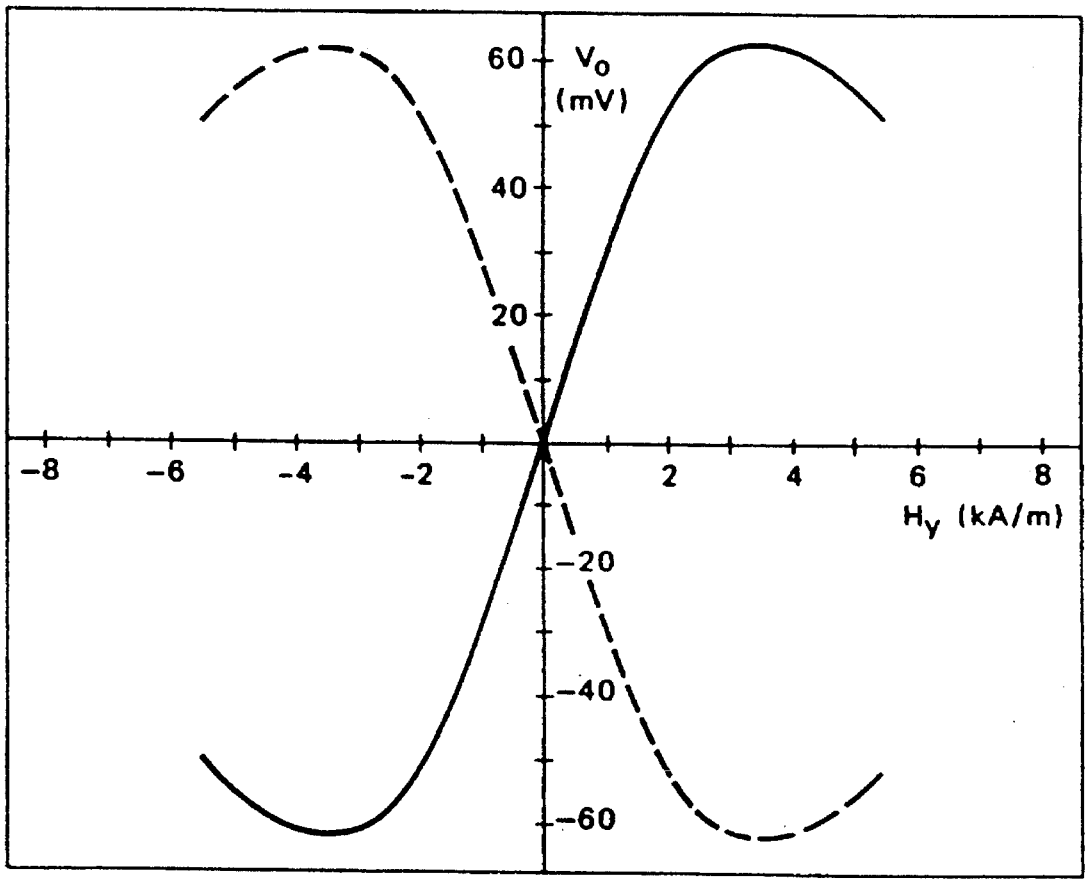
Fig. 2 Prior Art
FIG. 2 illustrates the magnetization characteristics for a Philips' magnetoresistive sensor.

The internal magnetization of the four permalloy strips comprising the sensor has two stable positions, so if the sensor is exposed to a strong magnetic field opposing the internal aligning field, the magnetization will flip from one position to the other, and the strips become magnetized in the opposite direction. This results in the slope of the sensor output voltage reversing polarity each time the sensor is flipped, as shown in FIG. 2 (FIG. 2 corresponds to FIG. 3 on page 3 of the aforementioned Technical publication 268 by Philips). In FIG. 2, the unbroken line shows the characteristic of a "normal" sensor (with the magnetization oriented in the +X direction), and the broken line shows the characteristic of a "flipped" sensor. Should the sensitive axis of the sensor be aligned with the null-field (i.e., East-West direction) while the sensor is flipping from one position to the other, the sensor output voltage will not change. Using the coil to periodically reverse the polarity will develop a peak-to-peak voltage at the sensor output which is approximately proportional to the horizontal magnetic flux lines of the earth and independent of offset. More importantly, for purposes of the present invention, the phase or polarity of the sensor output is indicative of the polarity of the horizontal magnetic flux lines of the earth. The following discussion will specify the structure and operation of the preferred embodiment of the invention.

Figure 3:
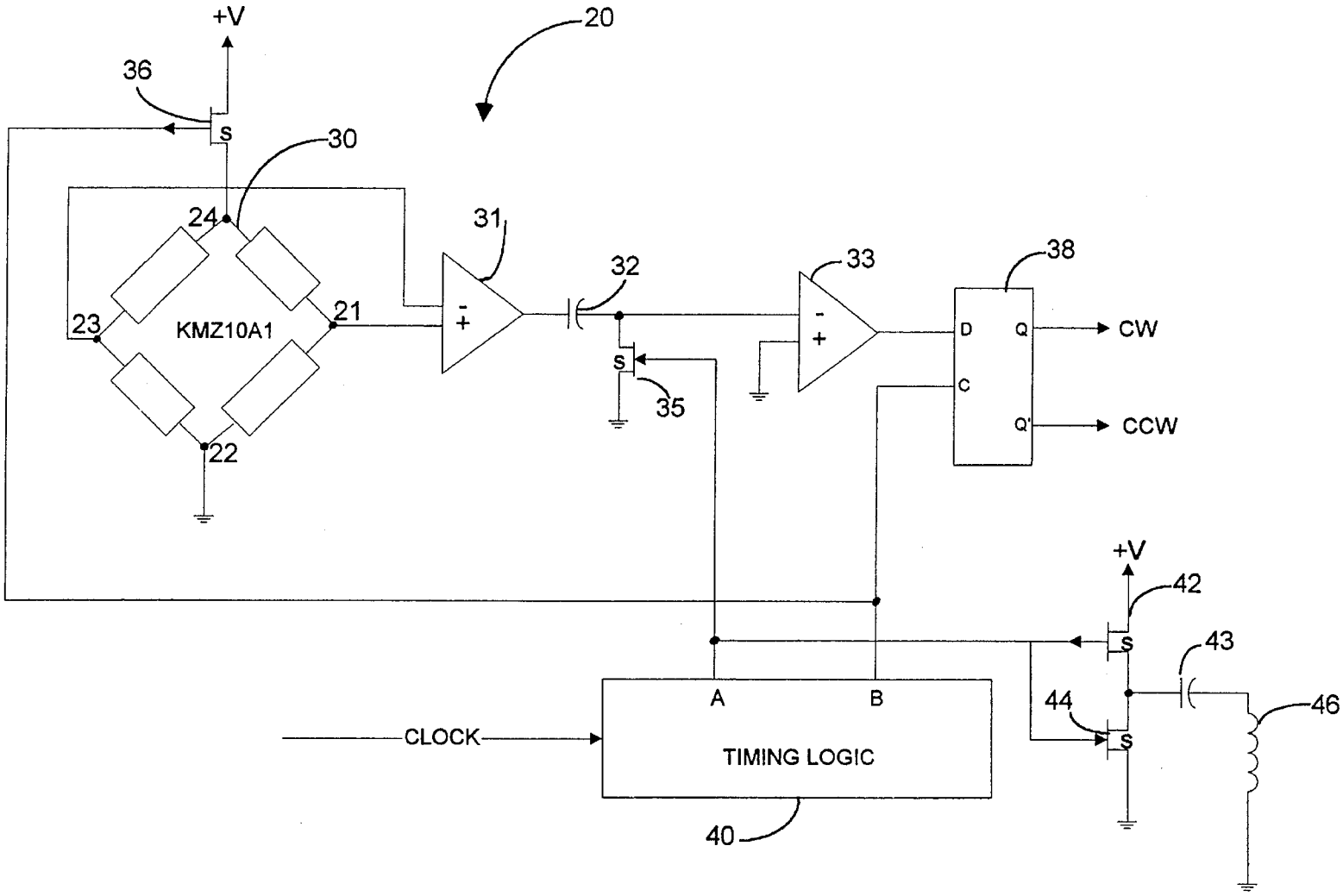
FIG. 3 shows a circuit diagram for the preferred embodiment of a wrist mountable compass of the present invention.

FIG. 3 shows a circuit diagram for the preferred embodiment of a wrist mountable compass 20 of the present invention. A Philips KMZ10A1 magnetoresistive sensor 30 is coupled to the source of a first p-channel junction field-effect transistor (JFET) 36 and a ground reference terminal at nodes 24 and 22, respectively. The drain of the first p-channel JFET 36 is coupled to a power supply voltage, +V. And the gate of the first p-channel JFET 36 is coupled to output B of a timing logic circuit 40, where the timing logic circuit 40 manipulates, in a known manner, pulses received from a clock to provide predetermined circuit driving pulses for the wrist mountable compass 20. Note that the timing logic circuit 40 will generally comprise serially connected flip-flops. Also, the clock is comprised of a conventional crystal controlled oscillator, such as that used in a conventional timepiece. Output of the sensor 30 is coupled to the inverting (–) and noninverting (+) inputs of a differential amplifier 31 at nodes 23 and 21, respectively. As is known, the differential amplifier 31 is used to amplify the output of the sensor 30. The output of the differential amplifier 31 is coupled to a first electrode of a first capacitor 32. A second electrode of the first capacitor 32 is coupled to the inverting (–) input of an operational amplifier 33. The second electrode of the first capacitor 32 is also coupled to the drain of a first n-channel JFET 35. The gate of the first n-channel JFET 35 is coupled to output A of the timing logic circuit 40, and the source of the first n-channel JFET 35 is coupled to the ground reference terminal. As for the noninverting (+) input of the operational amplifier 33, it is coupled to the ground reference terminal.

The output of the operational amplifier 33 is coupled to a data input (D) of a D flip-flop 38. Clock input (C) of the D flip-flop 38 is coupled to output B of the timing logic circuit 40. Complementary outputs (Q and Q') of the D flip-flop 38 are connected to a clockwise (CW) direction indicating means and a counterclockwise (CCW) direction indicating means, respectively. As will be described hereinbelow, the CW and CCW direction indicating means are preferably digital pointers.

A second p-channel JFET 42 has the gate coupled to output A of the timing logic circuit. The drain of the second p-channel JFET 42 is coupled to the power supply voltage, +V, and the source of the second p-channel JFET 42 is coupled to a first electrode of a second capacitor 43. The first electrode of the second capacitor 43 is also coupled to the drain of a second n-channel JFET 44. The gate and the source of the second n-channel JFET 44 are coupled to output A of the timing logic circuit 40 and the ground reference terminal, respectively. A second electrode of the second capacitor 43 is coupled to one terminal of a coil 46, which has a second terminal coupled to the ground reference terminal. Although not apparent from FIG. 3, note that in actual manifestation, the sensor 30 is located inside the windings of the coil 46 (see FIG. 27(*a*) on page 17 of the aforementioned Technical publication 268 by Philips).

Figure 4:
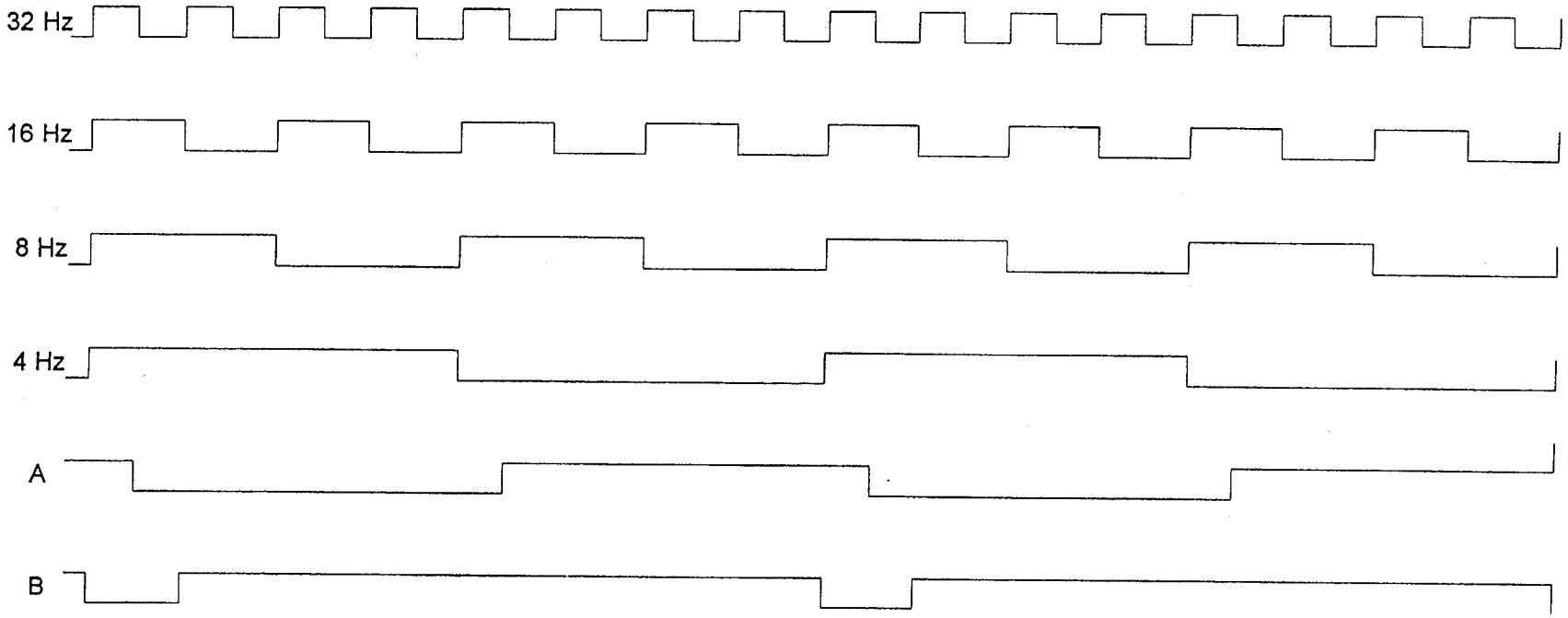
FIG. 4 shows a timing diagram for the circuit driving pulses driving the circuit illustrated in FIG. 3.

Operation of the Compass Portion of the Wrist Mountable Compass Timepiece of the Preferred Embodiment The operation of the circuit shown in FIG. 3 is to be understood in conjunction with the timing diagram of FIG. 4, which illustrates predetermined circuit driving pulses A and B provided by the timing logic circuit 40. Output B of the timing logic circuit 40, which drives the first p-channel JFET 36 to energize the sensor 30, has a ⅛ duty cycle. Note that the circuit of FIG. 3 would function properly if the sensor 30 was activated continuously, but this would require more power from the power source. The first capacitor 32 serves to remove the dc component from the output of the differential amplifier 31. The first n-channel JFET 35 clamps the first capacitor 32 to the ground reference terminal, preceding the flipping of the sensor 30. The sensor 30 is flipped by momentarily driving the coil 46 below the ground reference terminal by the actions of the second n-channel JFET 44 and the second capacitor 43 (collectively called the sensor flipping means). Upon release of the clamp, the voltage at the operational amplifier 33 will follow any transition in the output of the differential amplifier 31. Depending upon the polarity of the horizontal magnetic field, the inverting (–) input of the operational amplifier 33 will be driven above or below the ground reference terminal, causing the output of the operational amplifier 33 to respond accordingly.

The output of the operational amplifier 33 is latched by the D flip-flop 38 a finite time following the flipping of the sensor 30, after the signals have stabilized. As described above, the complementary outputs (Q and Q') of the D flip-flop 38 are used to drive the CW and CCW direction indicating means. The sensor 30 is then flipped or reset to the opposite polarity by the action of the second p-channel JFET 42 charging the second capacitor 43 (collectively called the sensor resetting means). To minimize peak current drain, the reset occurs while the sensor 30 is not energized.

Figure 5:
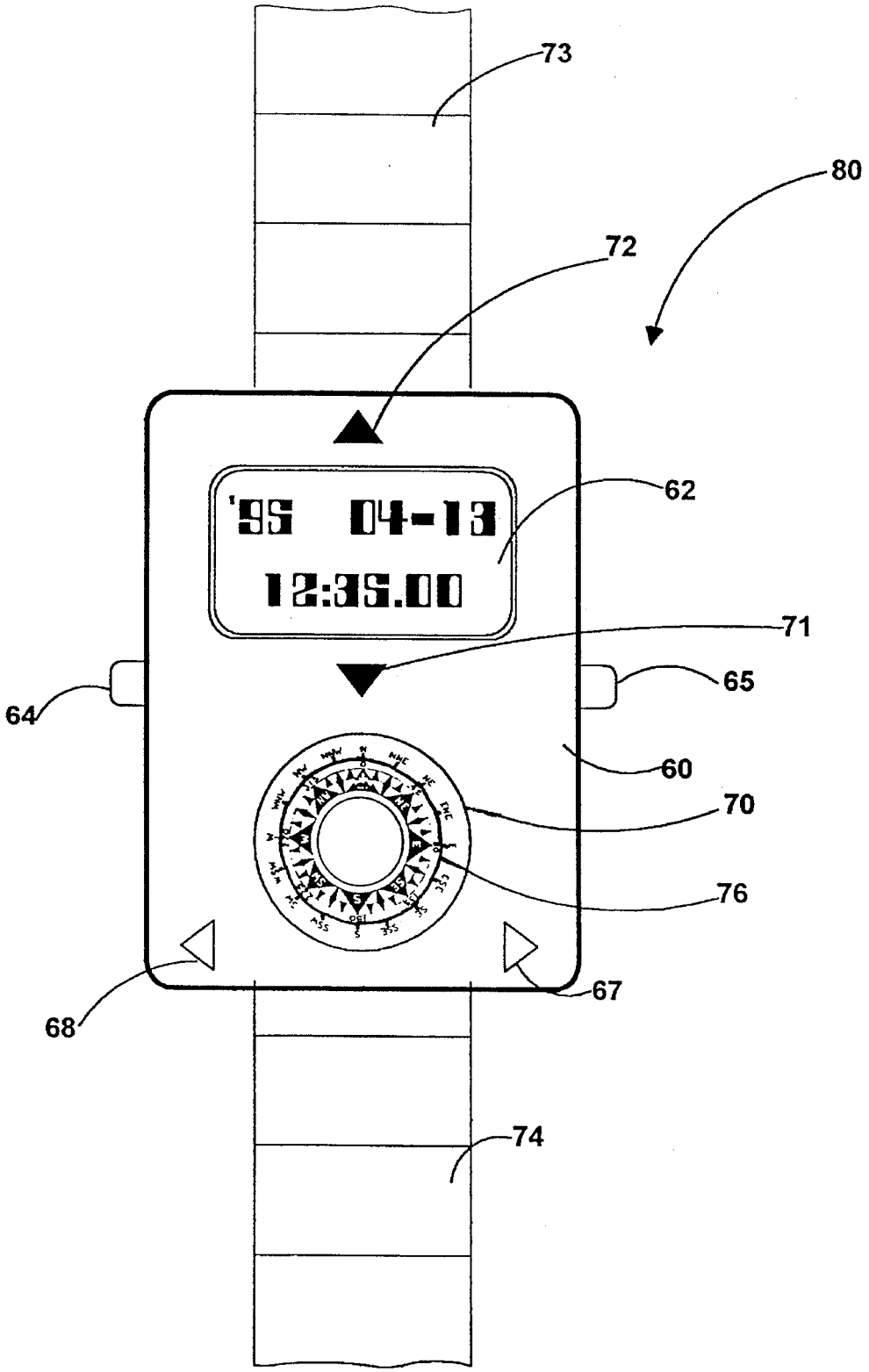
FIG. 5 shows a front view for a wrist mountable compass timepiece.
Figure 6:
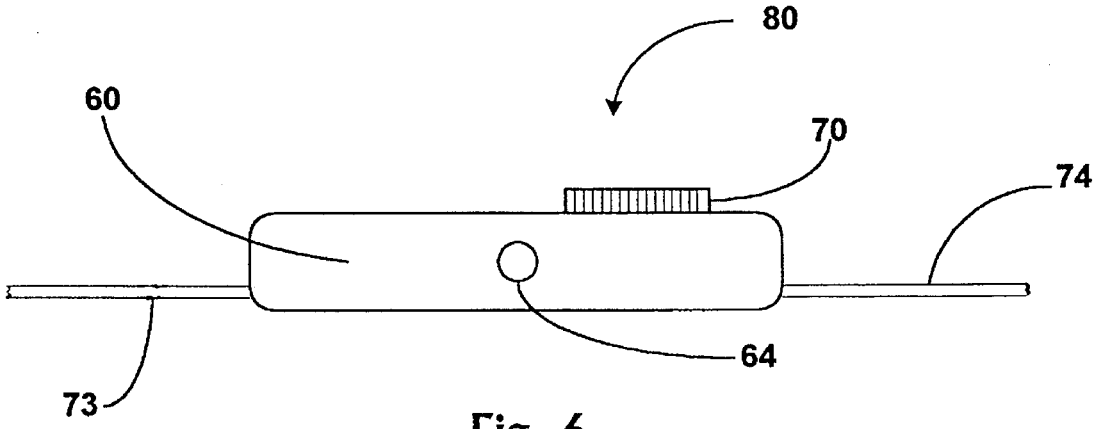
FIG. 6 shows a side view for the wrist mountable compass timepiece of FIG. 5.

FIGS. 5 and 6 are a front view and a side view, respectively, for the wrist mountable compass 20 of the present invention incorporated into a digital timepiece (collectively referred to as a wrist mountable compass timepiece 80). The wrist mountable compass timepiece 80 comprises a case 60 having an electro-optical display 62, such as a liquid crystal display (LCD), to display the time, date and other common timepiece functions, one or more operating switches 64, 65, digital pointers 67 and 68, which may comprise LEDs, a rotatable compass dial 70 having a compass card 76, and arrow markings 71 and 72 which are preferably printed onto the case 60. The wrist mountable compass timepiece 80 also includes straps 73 and 74 attached to the case 60 for fastening it to the wrist of a user. The timepiece functions, as well as the clock (providing pulses) and the timing logic circuit 40 of FIG. 3, are provided by a microprocessor located within the case 60, as is known in the art. The power source for the wrist mountable compass timepiece 80 is a battery (not shown) located within the case 60. The rotatable compass dial 70, which is coupled to the sensor 30 such that the sensor 30 rotates in conjunction with the dial 70, permits the user of the wrist mountable compass timepiece 80 to select the desired compass direction (e.g., northeast). The desired compass direction is selected by rotating the dial 70 until the desired direction is aligned with arrow marking 71. The rotation of the dial 70 is possible through the utilization of slip rings (not shown).

To activate and deactivate the compass circuit of FIG. 3, the user will have to depress one of the operating switches 64, 65. It is not significant for purposes of this invention which one of the switches 64, 65 is electrically connected to the compass circuit of FIG. 3. The compass circuit will automatically deactivate preferably 30 seconds after activation if the user has not manually deactivated the compass circuit. Note that the activation and deactivation of the compass circuit is preferably accomplished by the microprocessor controlling the timepiece functions, by means known in the art. When the compass circuit is activated, the digital pointers 67, 68 will indicate which direction the user must turn the wrist mountable compass timepiece 80 to align arrow marking 72 with the selected compass direction. For example, if the dial 70 is rotated until the northeast direction is selected and the compass circuit is activated by the depression of the appropriate switch 64 or 65, one of the digital pointers 67 or 68 will light up to indicate the direction to turn to. Once the selected direction is aligned with arrow marking 72, both digital pointers 67 and 68 will light up to indicate that arrow marking 72 is pointed towards the selected compass direction. Alternatively, both digital pointers 67 and 68 may be arranged to turn off when the selected direction is aligned with arrow marking 72.

Although FIGS. 5 and 6 illustrate the use of the rotatable compass dial 70 to permit selection of a desired compass direction, the present invention may also be practiced using a fixed compass direction (e.g., north). In this case, the user of the wrist mountable compass timepiece 80 would not be permitted to select a desired compass direction (limited to the preselected compass direction). The resulting embodiment would be akin to a "north finder." Also, although the preferred embodiment of the wrist mountable compass timepiece 80 utilizes digital pointers 67, 68 to indicate the direction to turn to, digital arrows appearing on the electro-optical display 62 may be used instead.

It is clear that in order to assure proper operation of the compass circuit of FIG. 3, certain precautions must be taken to shield the compass circuit from "parasitic" magnetic fields radiating from the rest of the wrist mountable compass timepiece 80. Since such precautionary measures are known in the art (e.g., see column 4, lines 11–26 in the above referenced '255 patent), further discussion will not be pursued here.

While there has been described what is considered to be the preferred embodiment of the invention, other modifications will occur to those skilled in the art, and it is desired to secure in the appended claims all such modifications as fall within the true spirit and scope of the invention.

I claim:

1. A wrist mountable compass having means for fastening to a wrist of a user, which comprises:

a magnetoresistive sensor coupled to a circuit means for sensing the polarity of the horizontal flux lines of the earth's magnetic field;

means for selecting a compass direction comprising a rotatable compass dial coupled to the magnetoresistive sensor such that the sensor rotates in conjunction with the dial;

a marking on the wrist mountable compass for orienting the compass relative to the horizontal flux lines of the earth's magnetic field;

an operating switch for activating the magnetoresistive sensor and the circuit means; and direction indicating means coupled to the circuit means for indicating the direction in which the wrist mountable compass should be turned so that the marking on the compass is directed towards the selected compass direction.

2. The wrist mountable compass according to claim 1, wherein the circuit means comprises:

a coil surrounding the magnetoresistive sensor;

a differential amplifier coupled to the output of the magnetoresistive sensor;

an operational amplifier having an input coupled to the output of the differential amplifier through a first capacitor, the first capacitor serving to remove the dc component from the output of the differential amplifier;

a first transistor coupled to the first capacitor and the input of the operational amplifier, the first transistor serving to clamp the first capacitor to ground;

a flip-flop having an input coupled to the output of the operational amplifier;

sensor flipping means coupled to the coil;

sensor resetting means coupled to the coil; and a timing logic circuit having outputs coupled to the first transistor, the flip-flop, the sensor flipping means and the sensor resetting means, the timing logic circuit serving to provide predetermined circuit driving pulses.

3. The wrist mountable compass according to claim 2, wherein the sensor flipping means comprises a second transistor and a second capacitor, and the sensor resetting means comprises a third transistor and the second capacitor.

4. The wrist mountable compass according to claim 1, wherein the rotatable compass dial has slip rings to permit rotation.

5. The wrist mountable compass according to claim 1, which further comprises means for automatically deactivating the magnetoresistive sensor and the circuit means after a preselected time period.

6. A wrist mountable compass timepiece having a power source, a timepiece circuit coupled to the power source to provide time information signals, and an electro-optical display to display time information in response to the time information signals, which comprises:

a magnetoresistive sensor coupled to a circuit means for sensing the polarity of the horizontal flux lines of the earth's magnetic field;

a compass dial rotatably mounted to the compass timepiece for selecting a compass direction, the compass dial being coupled to the magnetoresistive sensor such that the sensor rotates in conjunction with the dial;

a marking on the wrist mountable compass timepiece for orienting the compass timepiece relative to the horizontal flux lines of the earth's magnetic field;

an operating switch for activating the magnetoresistive sensor and the circuit means; and digital direction indicating means on the electro-optical display, the digital direction indicating means coupled to the circuit means for indicating the direction in which the wrist mountable compass timepiece should be turned so that the marking on the wrist mountable compass timepiece is directed towards the selected compass direction.

* * * * *